United States Patent [19]

Kimura

[11] Patent Number: 4,619,188

[45] Date of Patent: Oct. 28, 1986

[54] PNEUMATIC CYLINDER DEVICE WITH LOCKING MECHANISM

[75] Inventor: Takashi Kimura, Nagoya, Japan

[73] Assignee: Nippon Joucomatic Co., Ltd., Tokyo, Japan

[21] Appl. No.: 683,614

[22] Filed: Dec. 19, 1984

[30] Foreign Application Priority Data

Dec. 21, 1983 [JP] Japan ..... 58-241654

[51] Int. Cl.[4] ..... F15B 15/26

[52] U.S. Cl. ..... 92/26; 92/27

[58] Field of Search ..... 92/28, 27, 26, 24, 23; 91/44, 45, 41

[56] References Cited

U.S. PATENT DOCUMENTS

| | | | |
|---|---|---|---|
| 1,650,013 | 11/1927 | Gartin | 92/28 |
| 2,394,785 | 2/1946 | Kindervater | 92/28 |
| 3,203,513 | 8/1965 | Allen | 92/28 |
| 4,103,280 | 7/1978 | Cholet et al. | 91/44 |
| 4,185,539 | 1/1980 | Stratienko | 92/27 |

*Primary Examiner*—Robert E. Garrett

*Assistant Examiner*—Mark A. Williamson

*Attorney, Agent, or Firm*—Kenyon & Kenyon

[57] ABSTRACT

A pneumatic cylinder device with a locking mechanism has a pneumatic cylinder constituted by a cylinder, a piston slidably received in the cylinder and a piston rod extended from the piston outwardly of the cylinder, and a locking mechanism connected to the pneumatic cylinder and adapted to selectively lock the piston rod against movement. The locking mechanism comprises a housing through which the piston rod is slidably extended; a flexible tubular member disposed in the housing so as to surround the piston rod, the flexible tubular member being contractable and expandable radially; and annular pressure chamber formed around the flexible tubular member and having a variable volume; a volume changing means for causing a change in the volume of the pressure chamber; and a pressure transmission medium accommodated in the pressure chamber and adapted to transmit a pressure change, produced in the pressure chamber as a result of a volume change, to the flexible tubular member.

13 Claims, 5 Drawing Figures

PNEUMATIC CYLINDER DEVICE WITH LOCKING MECHANISM

BACKGROUND OF THE INVENTION

The present invention relates to a pneumatic cylinder device having a locking mechanims which locks the piston rod of the cylinder device during stroking as desired or in the event of a failure in the air supply.

Pneumatic cylinder devices having locking mechanisms are known. FIG. 4 shows, by way of example, a fluid-pressure type locking mechanims incorporated in some of these known pneumatic cylinder devices. This locking mechanism has a hydraulic pressure generating means 103 operatively associated with a brake 102 provided in the pneumatic cylinder 101. The force of a spring 104 incorporated in the hydraulic pressure generating means 103 is converted into pressure of a hydraulic fluid 105, which in turn is applied to the outer periphery of a brake metal 106 in the brake 102. As a result, the brake metal 106 having a slit 106' is radialy contracted so that the piston rod 107 is braked and stopped due to friction between the brake metal 106 and the piston rod 107.

FIG. 5 shows another known locking mechanism which may be referred to as "mechanical type" locking mechanism. This locking mechanism has a tightening member 114 having a wedging function and attached to a lock piston 113 resiliently mounted through a spring 112 in a lock cylinder 111 provided on the pneumatic cylinder 110. As the tightening member 114 is actuated, it presses a plurality of balls 115 which in turn press an annular lock shoe 117 on the peripheray of the piston rod 116 thus locking the piston rod 116.

The fluid-pressure type locking mechanism is advantageous in that the piston rod 107 can be braked by pressure which acts uniformly on the entire periphery of the brake metal 106, and in that it has an excellent durability because of small wear of the brake metal 106. However, this locking mechanism suffers from disadvantages in that the hydraulic pressure generating mechanism 103 projects laterally from the pneumatic cylinder 101 resulting in an extremely large size of the pneumatic cylinder device and in that troubles are often caused due to leak of the hydraulic fluid for operating the mechanism.

On the other hand, the mechanical-type locking mechanism involves various drawbacks, although it can provide a compact construction of the pneumatic cylinder device as a whole. Namely, in this locking mechanism, the braking pressure cannot be applied uniformly over the entire portions of the lock shoe or the brake metal 117 unlike the fluid-pressure type mechanism. In consequence, the lock shoe 117 makes contact with the piston rod 9 only at its selected portions so that it is worn locally resulting in a shorter life, i.e., inferior durability. In addition, the release of the wedging function of the tightening member 114 at the time of unlocking often involves a certain delay. Since different pneumatic pressures exist in the pressure chambers 119,120 at both sides of the piston 118 during locking, the delay in release of the wedging function may cause an increase of the pressure differential across the piston, resulting in an erroneous operation of the pneumatic cylinder device. Furthermore, the mechanical-type locking mechanism inherently suffers from a reduction in the efficiency due to friction in various mechancal parts.

SUMMARY OF THE INVENTION

Accordingly, an object of the invention is to provide a compact pneumatic cylinder device capable of locking and unlocking the piston rod thereof at a high efficiency and with high response characteristics.

Another object of the invention is to provide a pneumatic cylinder device in which the durability of the brake metal for applying the braking pressure to the piston rod is improved and, even after a substantial wear of the brake metal, the pressure applied to the brake metal can be re-adjusted easily.

To these ends, according to the invention, there is provided a pneumatic cylinder device with a locking mechanism comprising a pneumatic cylinder having a cylinder, a piston slidably received in the cylinder and a piston rod extending from the piston outwardly of the cylinder; and a locking mechanism connected to the pneumatic cylinder and adapted to selectively lock the piston rod against movement; the locking mechanism comprising: a housing through which the piston rod is extended slidably; a flexible tubular member disposed in the housing so as to surround the piston rod, the flexible tubular member being contractable and expandable in a radial direction for locking and unlocking of the piston rod; an annular variable-volume chamber formed around the flexible tubular member and having a variable volume; a volume changing means for causing a change in the volume of the pressure chamber; and a pressure transmission means accommodated in the pressure chamber and adapted to transmit a pressure change produced in the pressure chamber as a result of a volume change to the flexible tubular member.

The above and other objects, features and advantages of the invention will become clear from the following description of the preferred embodiments when the same is read in conjunction with the accompanying drawings.

DESCRIPTION OF THE PREFERRED EMBODIMENTS

Preferred embodiments of the invention will be described hereinunder with reference to the accompanying drawings.

Figure 1:
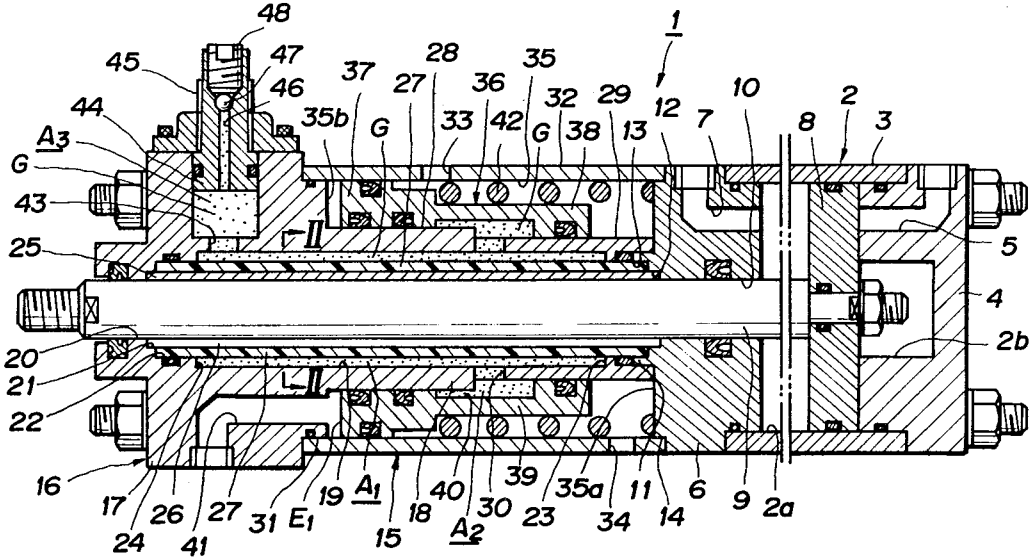
FIG. 1 is a longitudinal sectional view of a first embodiment of the pneumatic cylinder device with a locking mechanism.
Figure 2:
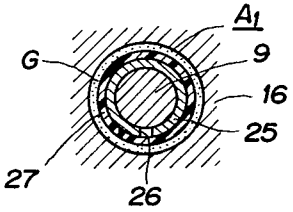
FIG. 2 is a sectional view taken along the line II—II of FIG. 1.

FIGS. 1 and 2 show a first embodiment of the pneumatic cylinder device with locking mechanism in accordance with the invention. The pneumatic cylinder device, generally designated by a reference numeral 1, is composed of two major parts: namely, a pneumatic cylinder 2 and a locking mechanism 15. The pneumatic cylinder 2 has a cylinder tube 3 to both ends of which are attached a head cover 4 and a rod cover 6 which are provided with a port 5 and a port 7, respectively. The cylinder tube 3 slidably receives a piston 8 such that a first pneumatic chamber 2a and a second pneumatic chamber 2b are formed at both sides of the piston 8 within the cylinder tube 3. A piston rod 9 attached to the piston 8 is slidably extended through a rod hole 10 formed in the rod cover 6 towards the locking mechanism 15. On the end of the rod cover 6 adjacent to the locking mechanism 15, is formed an annular projection 11 which fits into one end of an annular partition or a cylindrical part 18 of a brake body 16 incorporated in the locking mechanism 15. Steps 12 and 13 constituting supports for a brake metal 25 and a flexible thin-walled bush 27 are formed in the brim around the rod hole 10 in the rod cover 6 such as to be continuous to the inner periphery of the of the annular projection 11. A step 14 constituting a support for a tube 32 is formed in the outer peripheral portion of the same end surface of the rod cover 6 as the steps 12 and 13 mentioned above.

The locking mechanism 15 is constituted mainly by the brake body 16 which has a flange portion 17 and a cylindrical portion 18 integral with each other. The brake body 16 has an internal bore 19 the end of which adjacent to the flange 17 constitutes a rod hole 20 for slidably receiving the piston rod 9. Steps 21 and 22 corresponding to the steps 12,13 on the rod cover 6 are formed on the wall of the rod hole 10 so as to support the brake metal 25 and the flexible thin-walled bush 27. Circumferential ridges 23 and 24 are formed on the inner peripheral surface of the bore 19 at both axial end portions of the bore 19.

The brake metal 25 has a tubular form having an inner bore sized to receive the piston rod 9. An axial slit 26 is formed in the wall of this brake metal 25 over the entire length thereof so that the brake metal 25 can be contractable radially. On the other hand, the flexible thin-walled bush 27 is made of urethane rubber and has a tubular form sized to fit on the outer periphery of the brake metal 25. A first pressure chamber $A_1$ is formed between the outer peripheral surface of the flexible thin-walled bush 27 and the inner periphral surface of the brake body 16, when the brake metal 25 and the flexible thin-walled bush 27 are assembled together and mounted such as to be supported by the steps 12,13 on the rod cover 6 and the steps 21,22 on the brake unit 16.

A control piston 36 slidably fits around the cylindrical portion of the brake body 16. The outer peripheral surface of the cylindrical portion of the brake body 16 is stepped so that this brake body 16 has a large-diameter portion 28 and a small-diameter portion 29. Communication holes 30 of a predetermined diameter are formed in the small-diameter portion 29 at a location adjacent the large-diameter portion 28 so as to extend radially. A step 31 corresponding to the step 14 on the rod cover 6 is formed on the surface right-end as viewed in FIG. 1 of the flange portion 17 of the brake body 16. A tube 32 is supported at its both ends by these steps 14 and 31. A piston chamber 35 is defined by the inner peripheral surface of the tube 32 and the outer peripheral surface of the cylindrical portion 18 of the brake body 16. The control piston 36 is slidably received in this piston chamber 35. A peep hole 33 and a discharge port 34 are formed in the wall of the tube 32. The tube 32, rod cover 6 and the brake body 16 in combination constitute a locking mechanism housing.

The space in the piston chamber 35 is divided by the control piston 36 into a spring chamber 35a and a brake releasing chamber 35b. The control piston 36 has a piston body 37 adapted to slide along the outer peripheral surface of the large-diameter portion 28 of the brake unit 16 and the inner peripheral surface of the tube 32. The control piston 36 further has a slider 38 adapted to slide along the outer peripheral surface of the small-diameter portion 29. The piston body 37 and the slider 38 are connected to each other through a skirt 39. The skirt 39 is provided with a recess 40 formed in the inner peripheral surface thereof and having such a breadth as to extend over the large- and small-diameter portions 28 and 29. The recess 40 cooperates with the outer peripheral surface of the cylindrical portion 18 in defining therebetween a second pressure chamber $A_2$ which communicates with the first pressure chamber $A_1$ through the small radial communication holes 30 in the small-diameter portion 29. As a result of the movement of the control piston 36, the positions of the large- and small-diameter portions 28 and 29 of the piston 36 are varied with respect to the second pressure chamber $A_2$ thus changing the volume of this chamber $A_2$. The brake releasing chamber 35b is communicated with a brake releasing port 41 formed in the flange 17, while the spring chamber 35a accommodates a spring 42 which urges the control piston 36 towards the brake releasing chamber 35b. The spring chamber 35a is communicated with the atmosphere through a discharge port 34 formed in the tube 32. The flange 17 is provided with a cylindrical pressure chamber volume-adjusting chamber $A_3$which communicates through a radial communication hole 43 with the first pressure chamber $A_1$. A small piston 44 having a screw thread 45 is screwed into this chamber $A_3$ for free adjustment of its position. The small piston 44 has an axial bore 46 the upper end brim of which constitutes a conical seat for a small steel ball 47. A seal screw 48 is screwed into the small piston 44 at the upper side of the steel ball 47. A rubber gel G as a pressure transmission medium fills the space in the volume-adjusting chamber $A_3$, first pressure chamber $A_1$ and the second pressure chamber $A_2$ which are communicated with one another.

This rubber gel G may be an elastic potting gel ordinarly used in electric telecommunication equipments. This rubber gel G may be prepared by, for example, vulcanizing, at a low temperature, a gel "Shinetsu Silicone KE 104 Ge" produced by Shinetsu Kagaku Kogyo Kabushiki Kaisha under the influence of a catalyst "#104" produced by the same company.

The total volume of the chambers $A_1$, $A_2$ and $A_3$ is appropriately adjusted by means of the small piston 44 such that the following function is achieved before the end surface E, of the piston body 37 of the control piston 36 comes into contact with the flange 17. When the supply of the pneumatic pressure to the brake releasing chamber 35b is stopped, the control piston 36 is biased towards the brake releasing chamber 35b by the action of the spring 42 so that the rubber G in the second pressure chamber $A_2$ is compressed until the end surface $E_1$ of the piston body 37 of the control piston 36 comes into contact with the end adjacent to the flange 17. The pressure thus produced in the second chamber $A_2$ is propagated to the rubber G in the first pressure chamber $A_1$ so that the brake metal 25 is pressed uniformly onto the outer peripheral surface of the piston rod 9 through the flexible thin-walled bush 27, whereby the piston rod 9 is stopped due to frictional resistance between the piston rod 9 and the brake metal 25.

The operation and the advantages of the first embodiment are as follows.

In operation, compressed air is supplied from a compressed air source (not shown) into the brake releasing chamber 35*b* through the brake releasing port 41. In consequence, the control piston 36 is pressed towards the rod cover 6 by the force produced by the pneumatic pressure, overcoming the force of the spring 42. In this case, therefore, no pressure is produced in the second pressure chamber $A_2$ so that the brake metal 25 is freed to maintain natural width of the slit 26 therein. In this state, the piston rod 9 is not pressed by the brake metal 25 so that it can be driven freely in the axial direction. Thus, the piston rod is in the unlocked condition. In this state, the piston rod 9 is driven to the left and right as viewed in FIG. 1, by the selective supply and discharge of the compressed air into and out of the first and the second pneuamtic chambers 2*a* and 2*b* through the ports 7 and 5.

When the compressed air in the brake releasing chamber is relieved, the control piston 36 is moved by the spring 42 so that the rubber gel G in the second pressure chamber $A_2$ is pressurized to generate a pressure which is propagated through the communication holes 30 to the rubber gel G in the first pressure chamber $A_1$, thereby pressing the brake metal 25 radially inwardly through deformation of the flexible thin-walled bush 27. Consequently, the brake metal 25, through a reduction of the width of its slit 26, comes into pressure contact with the piston rod 9 thus stopping the piston rod 9. It is thus possible to stop the piston rod 9 without delay after the release of the air from the brake releasing chamber 35*b*, regardless of the position of the piston rod 9.

This means that the piston rod 9 is stopped and held at the instant position whenever the driving air supply is failed accidentally for any reason. When the supply of the driving air is recovered, the air is supplied to the pneumatic cylinder 2 and, at the same time, also to the brake releasing chamber 35*b*, so that the piston rod 9 is unlocked immediately to commence its operation.

This locking mechanism can operate with a high response characteristic because the locking operation is made by a radial contraction of the brake metal 25 by a pressure generated in the second pressure chamber $A_2$ as a result of the action of the spring 42. In particular, the unlocking operation can be effected without delay because this operation is achieved without encountering any substantial mechanical friction which is unavoidable in the conventional mechanical-type locking mechanism, so that troubles such as erroneous operation due to delay of unlocking is eliminated advantageously. The use of the rubber gel G as the pressure transmission medium eliminates the necessity for leak prevention measure which is indispensable in the conventional fluid-pressure type locking mechanism. The packing seals in respective pressure chambers are used when these chambers are filled with the rubber gel and, hence, can be omitted from the view point of principle of operation of the device. It is to be noted also that the brake metal 25 can stand a long use because the whole portion thereof is pressed equally onto the piston rod 9 thanks to the use of rubber gel G as the transmission medium. Furthermore, the pneumatic cylinder device 1 as a whole can have a compact construction with neat appearance because there is almost no part which would project radially from the outer peripheral surface of the pneumatic cylinder.

Figure 3:
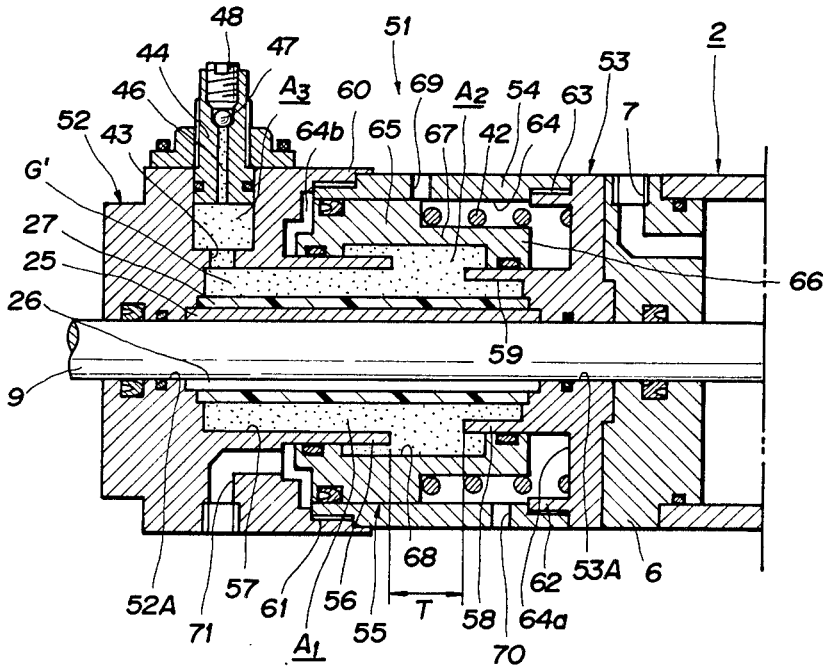
FIG. 3 is a longitudinal sectional view of an essential part of a second embodiment.
Figure 4:
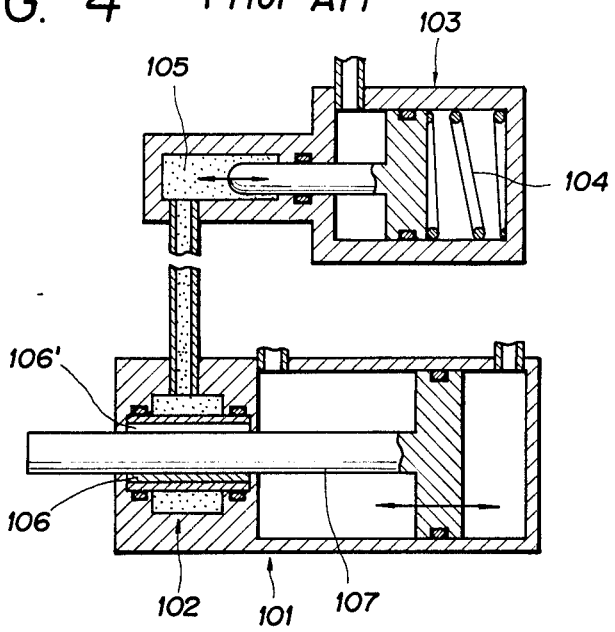
FIG. 4 Prior Art
FIGS. 4 and 5 are longitudinal sectional views of different examples of conventional pneumatic cyliders with locking mechanisms.
Figure 5:
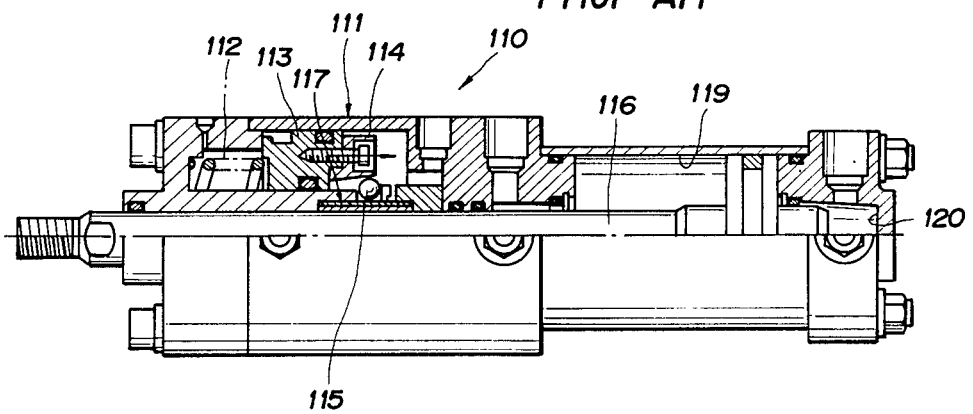
FIG. 5 Prior Art

A second embodimenht of the invention will be described hereinunder with specific reference to FIG. 3. The second embodiment of the pneumatic cylinder device of the invention has a locking mechanism 51 which is contructed as a separate body from the pneumatic cylinder 2. The locking mechanism 51 is constituted mainly by two end covers 52,53 with respective flanges, a tube 54 and a control piston 55. A first slider wall 56 having a large-diameter is formed on the inner side surface of the cover 52. A recess 57 formed in the inner surface of the wall 56 partly defines a pressure chamber $A_1$. A second slider wall 58 of a small-diameter is formed on the inner surface of the cover 53. The inner surface of this wall 58 has a recess 59 partly defining the pressure chamber $A_1$. An external screw thread 61 for engagement with a screw thread 60 formed in the cover 52 is formed on the outer peripheral surface of the tube 54 at one axial end of the latter. An internal screw thread 63 formed in the other end of the tube 54 engages with an external screw thread 62 formed on the cover 53. The covers 52 and 53 have central bores 52A,53A for receiving the piston rod 9 and also have steps 52B and 53B which support the brake metal 25 and the flexible thin-walled bush 27 similarly to the first embodiment. When both covers are screwed properly to the tube 54, the ends of the slide walls 56 and 58 come to oppose to each other with a predetermined gap T left therebetween. In this state, the first pressure chamber $A_1$ is formed between the outer peripheral surface of the flexible thin-walled bush 27 and the slide walls 56 and 58, while a piston chamber 64 is formed between the tube 54 and the outer surfaces of the slide walls 56 and 58. This piston chamber 64 receives a control piston 55 which has, as in the case of the first embodiment, a piston body 65, slider 66 and a skirt 67. The control piston 55 divides the space in the piston chamber 64 into two compartments: namely, a spring chamber 64*a* and a brake releasing chamber 64*b*. The spring chamber 64*a* accommodates a spring 42 adapted to bias the piston 55 in one direction. The skirt 67 is provided with a recess 68 in the inner peripheral surface thereof, so that a second pressure chamber $A_2$ is formed between the skirt 67 and the slide walls 56,58. This second pressure chamber $A_2$ communicates with the first pressure chamber $A_1$ through the above-mentioned gap T. The pressure chambers $A_1$ and $A_2$ thus formed are filled with an easily-deformable pressure transmission medium such as, for example, a clay G′ ordinarily used in handicrafts.

A reference numeral 69 denotes a peep hole formed in the wall of the tube 54, while a numeral 70 denotes a discharge port also formed in the wall of the tube 54. A brake releasing port 71 communicating with the brake releasing chamber 64*b* is formed in the cover 52.

In assembling, the piston rod 9 is inserted into the locking mechanism 51 which in turn is united with the pneumatic cylinder 2 by means of, for example, bolts. the pneumatic cylinder 2 itself has a construction substantially the same as that of the first embodiment. As in the case of the first embodiment, a pressure chamber volume adjusting chamber $A_3$, communicating with the first pressure chamber $A_1$, is formed in the cover 52.

This second embodiment of the pneumatic cylinder device operates substantially in the same manner as the first embodiment. Namely, when the compressed air in the brake releasing chamber 64*b* is relieved during stroking of the piston rod 9, the control piston 55 is moved by the spring 42 so as to pressurize the clay G′ in the second pressure chamber $A_2$ thereby generating a pressure which in turn acts in the same manner as the first embodiment. This locking mechanism 51 is constructed as a body separate from the pneumatic cylinder 2 and 15 detachably secured to the latter, thus facilitating the repair of the pneumatic cylinder device.

In the first and second embodiments, the state of operation of the locking mechanism can be checked by, for example, confirming the position of the transmission medium such as the rubber gel G or the clay G' by observing the position of the control pistons 36,55 through the peep holes 33,69. To facilitate this checking, the outer peripheral surfaces of the control pistons 36,55 may be provided with a mark line. The small piston 44 permits the adjustment of the operation in accordance with any change in the operating condition such as an expansion or contraction of the pressure transmission medium due to a change in the ambient air temperature. Namely, by screwing the small piston 44 into and out of the adjusting chamber $A_3$, the total volume of the pressure chambers is changed to compensate for such a change in the operating condition. When the brake metal 25 has been worn down, the condition for contact of the brake metal 25 with the piston rod 9 is changed improperly. The good contacting condition, however, can be recovered by screwing the small piston 44 into the adjusting chamber $A_3$ so as to reduce the total volume of the pressure chambers.

The use of the rubber gel or the clay as the easily deformable pressure transmission medium is not exclusive and the pressure transmission medium may be any other suitable material such as, for example, an easily deformable powdered or granular material or may be a soft rubber such as a urethane rubber having a low rigidity.

As will be clear from the foregoing description, according to the invention, it is possible to stop and lock the piston rod even in the event of an interruption of the driving air supply to the brake releasing chamber due to any trouble in the driving air supply system, because the brake metal is pressed without fail by the pressure produced by the urging means such as the spring and transmitted through the pressure transmission system in the first and the second pressure chambers.

Thus, in the pneumatic cylinder device of the invention, the locking and unlocking rely upon radial contraction and expansion of the brake metal which in turn is caused by application and release of a pressure obtained in the second pressure chamber as a result of a conversion from a mechanical force. Therefore, the locking and unlocking operation can be conducted with high response characteristics of operation. In particular, the unlocking is made without substantial delay thereby eliminating troubles such as erroneous operation experienced with conventional mechanical-type pneumatic cylinder devices due to delay in the unlocking attributable to frictions of various mechanical parts.

Furthermore, the leak of the pressure transmission medium is remarkably suppressed thanks to the use of an easily deformable substance such as a rubber gel, fat clay or the like as the pressure transmission medium.

In addition, the brake metal can stand a longer use because it can contact at its entire part with the piston rod during the braking and the locking.

The pneumatic cylinder device of the invention can have a simple construction and a neat appearance because almost no part projects radially from the outer peripheral surface of the pneumatic cylinder.

What is claimed is:

1. A pneumatic cylinder device with a locking mechanism comprising a pneumatic cylinder having a cylinder, a piston slidably received in said cylinder and a piston rod extending from said piston outwardly of said cylinder; and a locking mechanism adapted to selectively lock said piston rod against movement;

said locking mechanism comprising:

a housing disposed adjacent said cylinder and through which said piston rod is slidably extended;

a flexible tubular member disposed in said housing so as to surround said piston rod, said flexible tubular member being contractable and expandable in a radial direction for locking and unlocking of said piston rod;

an annular variable-volume chamber means formed around said flexible tubular member and having a variable volume;

a volume changing means for causing a change in the volume of said variable-volume chamber means; and a pressure transmission means accommodated in said variable-volume chamber means and adapted to transmit to said flexible tubular member a pressure change produced in said variable-volume chamber means as a result of a volume change; and said variable-volume chamber means including a first pressure chamber formed between the outer peripheral surface of said flexible tubular member and the inner peripheral surface of an annular partition wall means extending in said housing in the axial direction, said partition wall means having a large-diameter portion and a small-diameter portion; and a second pressure chamber defined by a stepped outer peripheral surface of said annular partition wall means and a recess formed in the inner peripheral surface of a control piston slidably fitted over said stepped outer peripheral surface, said second pressure chamber communicating with said first pressure chamber through communication passage means formed in said annular partition wall means, said second pressure chamber extending over at least said small-diameter portion of said annular partition wall means, the volume of said second pressure chamber being variable as a result of axial sliding movement of said control piston with respect to said annular partition wall means.

2. A pneumatic cylinder device with a locking mechanism according to claim 1, wherein said volume changing means includes a piston body formed on one axial end of said control piston and disposed in said housing of said locking mechanism, said piston body being slidably received in a cylinder chamber formed around the outer peripheral surface of said annular partition wall means within said housing; a brake releasing chamber formed on one side of said control piston adjacent said piston body within said cylinder chamber; and a biasing means disposed on that side of said control piston opposite to said piston body and adapted to bias said control piston towards said brake releasing chamber.

3. A pneumatic cylinder device with a locking mechanism according to claim 2, wherein said biasing means is adapted to bias said control piston in the direction for reducing the volume of said second pressure chamber; and wherein said piston body is adapted to move, when said brake releasing chamber is supplied with a pressurized fluid from a source of pressure, in the direction for increasing the volume of said second pressure chamber, overcoming the force of said biasing means.

4. A pneumatic cylinder device with a locking mechanism according to claim 1, wherein said locking mechanism further comprises a volume adjusting chamber formed in said housing of said locking mechanism and communicating with said variable-volume chamber, said volume-adjusting chamber accommodating a part of said pressure transmission means, whereby the pressure of said pressure transmission means in said variable-volume chamber is adjusted by a change in the volume of said volume-adjusting chamber.

5. A pneumatic cylinder device with a locking mechanism according to claim 1, wherein said pressure transmission means comprises an easily deformable material.

6. A pneumatic cylinder device with a locking mechanism according to claim 5, wherein said material is a rubber gel.

7. A pneumatic cylinder device with a locking mechanism according to claim 5, wherein said material is a clay.

8. A pneumatic cylinder device with a locking mechanism according to claim 5, wherein said material is a granular material.

9. A pneumatic cylinder device with a locking mechanism according to claim 1, wherein said flexible tubular member comprises a tubular brake metal surrounding said piston rod and having an axial slit, said brake metal allowing in its free state the free axial movement of said piston rod; and a flexible thin-walled bush fitted around said brake metal.

10. A pneumatic cylinder device with a locking mechanism according to claim 1, wherein said annular partition wall means comprises a stepped cylindrical member integrally formed with an end wall of said housing and extending therefrom toward the opposite end wall of said housing.

11. A pneumatic cylinder device with a locking mechanism according to claim 10, wherein said communication passage means comprises communication holes formed through said stepped cylindrical member.

12. A pneumatic cylinder device with a locking mechanism according to claim 1, where in said annular partition wall means comprises a first cylindrical member integrally formed with an end wall of said housing and constituting said large-diameter portion, and a second cylindrical member integrally formed with the opposite end wall of said housing and constituting said small-diameter portion.

13. A pneumatic cylinder device with a locking mechanism according to claim 12, wherein said communication passage means comprises an annular gap formed between the opposing ends of said first and second cylindrical members.

* * * * *